United States Patent [19]

Viola

[11] Patent Number: 4,825,226

[45] Date of Patent: Apr. 25, 1989

[54] POWER ANTENNA ADAPTER FOR REPLACEMENT ANTENNA

[75] Inventor: Frank J. Viola, Sandy Hook, Conn.

[73] Assignee: Parker-Hannifin Corporation, Cleveland, Ohio

[21] Appl. No.: 139,393

[22] Filed: Dec. 29, 1987

[51] Int. Cl.[4] ..... H01Q 1/10

[52] U.S. Cl. ..... 343/901; 343/903

[58] Field of Search ..... 343/713, 715, 901, 903; 318/266, 467, 671

[56] References Cited

U.S. PATENT DOCUMENTS

| | | | |
|---|---|---|---|
| 2,695,957 | 11/1954 | Cone | 343/880 |
| 2,933,597 | 4/1960 | Jensen | 343/880 |
| 3,022,420 | 2/1962 | Brinkerhoff | 455/234 |
| 3,873,985 | 3/1975 | Altmayer | 343/714 |
| 4,190,841 | 2/1980 | Harada | 343/901 |
| 4,591,868 | 5/1986 | Cusey et al. | 343/903 |

*Primary Examiner*—William L. Sikes
*Assistant Examiner*—Doris J. Johnson
*Attorney, Agent, or Firm*—Ralph E. Jocke

[57] ABSTRACT

Converter apparatus for interconnecting a universal replacement power antenna to the original equipment components of a vehicle radio system or the like, and for automatically steering the electrical control signals to maintain the proper up-down operating function. The connector apparatus comprises an electronic converter module, a group of wire terminal connectors and a connector block, the latter consisting of a three lead, polarized female connector, compatible with an existing connector in the vehicle system. A pair of diodes are used in the electronic converter module to automatically steer control signals among three interconnecting wires between the original equipment antenna relay and the replacement antenna relay.

12 Claims, 2 Drawing Sheets

POWER ANTENNA ADAPTER FOR REPLACEMENT ANTENNA

BACKGROUND OF THE INVENTION

This invention relates to motor vehicle antennas and more particularly to apparatus for ensuring the proper interconnection of a replacement power antenna with existing vehicle componentry.

Typical universal power replacement antennas include an antenna relay in the package for effecting the switching control over the antennas motor for driving the antenna between extended and retracted positions. In the usual application, the replacement antenna is designed for actuation from a remote switching device provided either by a toggle switch actuated mechanically by the operator of the vehicle or semi-automatically by an internal switch in the radio of the vehicle which is actuated when the radio is turned on and off. In this application, the interchange of a replacement antenna is fairly convenient as the reversing circuitry is replaced as well with the interchange of the antennas and only a simple wire interconnection is required.

In some applications however, the antenna relay itself is remote from the antenna and is more closely associated with the vehicle radio, usually being located beneath the dashboard of the vehicle and in an inconvenient location. These systems are designed for replacement antennas that only include the antenna and drive motor since it is expected that the original antenna relay will be retained.

In trying to mate such a system however, with a universal replacement antenna, it is obvious that difficulties are encountered as two sets of antenna relays will be included in the system and it will be impossible to provide the proper switching signals by a simple interconnection of components. As noted, it is difficult and inconvenient to gain access to the original equipment relay since it is beneath the dashboard. However, in the past, such procedure was required or alternatively, a specially designed replacement antenna was required. This obviated the advantages of a universal replacement antenna which would be suitable for all situations and which could accordingly be obtained at an advantageous price.

One typical design of prior art antenna is shown in U.S. Pat. No. 2,695,957 which shows a projectable antenna and the associated electrical switching circuitry therefor. This type of circuity is designed primarily for manual actuation.

In U.S. Pat. Nos. 2,933,597 and 3,022,420, control circuits are described for power antennas. These circuits include control relays and describe how the relays may be energized concurrently with actuation of the associated radio or other receiver.

U.S. Pat. No. 3,873,985 shows yet another version of power antenna and the electrical switching mechanism therefor. In this showing limit switches are described in detail, these being microswitches activated at either end of travel of the antenna rod.

SUMMARY OF THE INVENTION

A universal replacement antenna package provides accommodation for many different original equipment antenna systems by the inclusion of electronic converter apparatus which can be utilized where an original equipment relay is retained and in most other applications. The replacement antenna includes a conventional retractable antenna and drive motor therefor, together with an associated antenna relay and switching contacts. An electronic converter module is included which may be interconnected between the replacement antenna and the receiver of the vehicle without the necessity for removal of the original equipment relay. The converter module includes a wiring harness for making the electrical interconnection, suitable terminals at either end for creating the electrical junctions and includes a pair of steering diodes for appropriately routing the flow of current to properly actuate the antenna motor in the correct motion of extension or retraction. In its preferred form, the converter module includes the diodes in a molded plastic package with electrical leads having wire terminal connectors at one end and a three lead, polarized junction block connector at the other end, the latter being directly mateable with an accessible electrical connector of the original equipment system.

BRIEF DESCRIPTION OF THE DRAWINGS

FIG. 3 is a schematic illustration of the electrical control circuit of a conventional power antenna for motor vehicles, and the like.

DETAILED DESCRIPTION OF THE INVENTION

Figure 1:
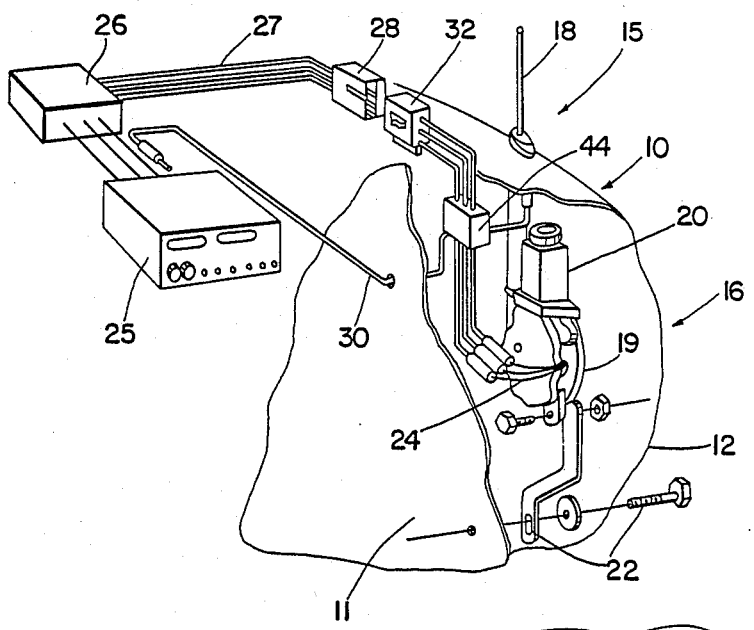
FIG. 1 is a fragmentary perspective view of the antenna converter apparatus of the invention housed in a conventional motor vehicle environment.

The replacement antenna apparatus 10 of the invention is shown in FIG. 1 in association with a portion of a motor vehicle, in this instance being an interior bulkhead 11 of the vehicle and fender 12. The universal replacement antenna apparatus 10 consists of electronic converter apparatus 15, which is shown isolated in FIG. 2, and a replacement power antenna 16. The power antenna 16 comprises antenna rod 18, drive motor 19, replacement antenna relay 20 and associated coils and contacts to be described in further detail.

The replacement power antenna 16 is mounted to bulkhead 11 of the vehicle by suitable brackets and bolts as indicated at 22, arranged so that antenna rod 18 protrudes through an opening in fender 12, in a conventional manner, in replacement of original equipment components or the like. Antenna rod 18 is adapted for movement between extended and retracted positions, being moved by drive motor 19 in a manner well understood in the art. In this embodiment of the invention, three interconnecting wire leads 24 are utilized to supply electrical power to replacement antenna 16. The three leads 24 are energized in individual pairs to supply suitable power to drive motor 19 to operate the motor in forward or reverse directions for extending or retracting antenna rod 18. While such replacement antenna 16 could be simply energized by a suitable manually actuated remote switch to receive appropriate voltage polarities, in many instances the replacement antenna 16 is used with original equipment apparatus which provides a different scheme for application of electrical power which is not directly compatible. In this instance, the electronic converter apparatus 15 is utilized to assure that the proper operating power is supplied to replacement antenna 16.

A typical original equipment system is depicted in FIG. 1 as comprising radio receiver 25, an original equipment relay 26 and wiring harness 27, the latter terminating in a three prong connector block 28. Radio 25 is typically mounted in the dashboard of the vehicle and accessible from therebehind to receive electrical power from a power source such as the battery of the vehicle and to interconnect with antenna rod 18 by means of antenna cable 30. Original equipment relay 26 may be directly associated with radio 25 or separately mounted but typically also is mounted behind the dashboard of the vehicle and often behind other structure, such as bulkhead 11. Relay 26 thus is virtually inaccessible or at least in an extremely inconvenient location and for this reason, electrical power emanating therefrom is transmitted via harness 27 and connector block 28 to a location near where replacement antenna 16 is installed. Then, it is much more convenient to be able to interconnect the original equipment components with replacement power antenna 16 by means of the electronic converter apparatus 15.

Figure 2:
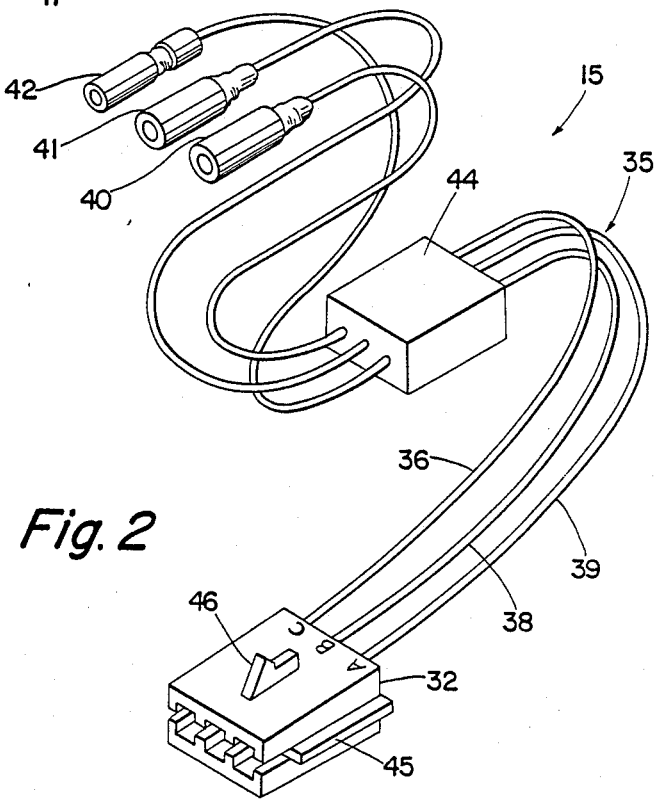
FIG. 2 is an enlarged perspective view solely of the converter apparatus of the invention, removed from the vehicle of FIG. 1.

The electronic converter apparatus 15 is seen more clearly in FIG. 2 as comprising a three terminal connector block 32, cable 35 consisting of three conductive wires 36, 38, 39, three wire connectors 40, 41, 42 and electronic converter module 44 intermediate the ends of cable 35. Connector block 32 is of mating configuration to original equipment converter 28 and includes a ridge 45 at one edge to assure that proper polarization is realized. A further ridge 46 is provided at one side of connector 32 to serve as a latch for retaining the connectors in engagement, in duplication of the original equipment manufacturer's joining techniques.

Figure 3:
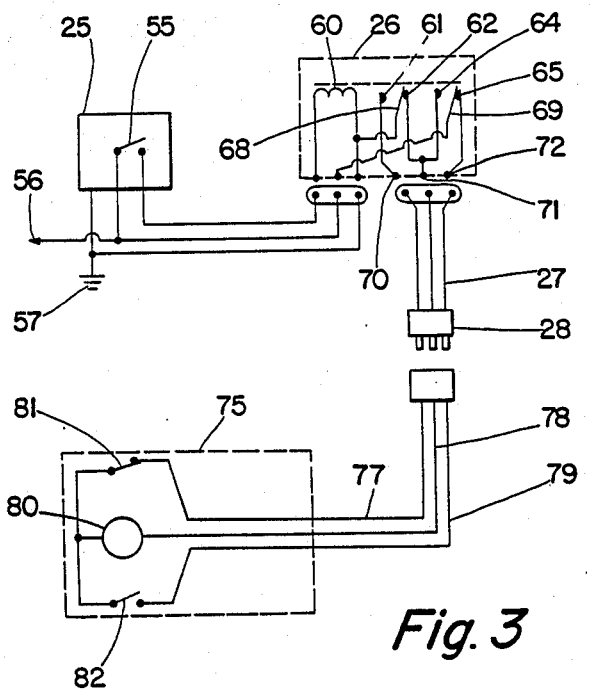
Figure 4:
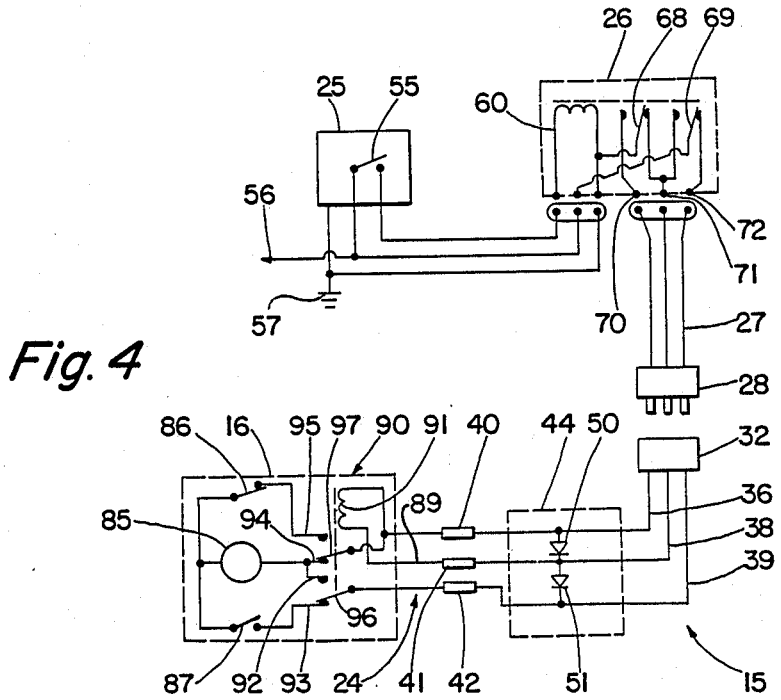
FIG. 4 is a schematic illustration of the electrical control circuit of the converter apparatus of the invention in conjunction with a universal replacement power antenna and certain of the conventional power antenna components described in FIG. 3.

As seen more clearly in FIGS. 3 and 4 which are electrical schematic diagrams of the circuitry, and in which common reference numerals are used insofar as possible, electronic converter module 44 comprises a pair of diodes 50, 51 connected between the wires 36, 38, 39 of cable 35, with the cathode of diode 50 and the anode of diode 51 commonly connected to wire 38.

Referring specifically to FIG. 3 the schematic for original equipment components is depicted as including radio receiver 25 having an internal switch 55 and connected to receive energization from power source 56 and connected to common ground 57. It will be understood that power source 56 and ground 57 are supplied from the vehicle battery or the like to supply energizing power and may be of either polarity. For purposes of this explanation, it will be assumed that power source 56 is more positive those ground 57, but a similar operation could be obtained by a reversal of polarity and reversal of diodes 50, 51.

Original equipment relay 26 comprises energizing coil 60 and associated switching contacts consisting of a pair of ground contacts 61, 62, a pair of power contacts 64, 65 and respective ground and power switching contacts 68, 69. Relay 26 thus provides various combinations of voltages at its output terminals 70, 71, 72 which are in turn connected to original equipment harness 27 to provide the voltage combinations at connector block 28. As shown in the de-energized condition of FIG. 3, with radio switch 55 in an open position, power source 56 is connected by suitable wiring to moveable contact 69 to apply positive voltage to power contact 65 and output terminal 72. Ground 57 is connected similarly to moveable contact 68, ground contact 62 and output terminal 71. In this manner, it may be seen that power is applied to original equipment power antenna 75 by means of connecting wires 77, 78, 79, with wire 79 receiving positive potential and wire 78 connected to ground 57. Antenna motor 80 thus receives power to extend or retract the antenna rod, being connected as well by way of antenna rod contacts 81, 82 which are responsive to the extended and retracted positions of the antenna rod. It will be understood that antenna rod contact 82 is closed at the fully extended position of the antenna rod and remains closed until the antenna rod is fully retracted. Contact 81 is poled to contact 82 and operates in a reverse manner, with the contacts shown in tee position in FIG. 3 with the antenna rod fully retracted. In moving to this position, however, motor 80 is energized by positive power at wire 79 and contact 82, being connected to ground 57 by way of wire 78 to retract the antenna until contact 82 opens to disconnect power.

When radio 25 is turned on, radio switch 55 will connect power source 56 to coil 60 thereby switching contacts 68, 69 to their alternate positions, connecting power source 56 via switch 69 and contact 64 to output terminal 71 and connecting ground 57 via switch 68 and contact 61 to output terminal 70. Thus, by virtue of the interconnecting harness 27 power source 56 will be connected to wire 78 and ground 57 to wire 77. With rod contact 1 in the closed position depicted, motor 80 will run in the opposite direction, extending the antenna rod, until the end position is reached and contact 81 opens to stop the movement.

Referring to FIG. 4 where similar numerals are utilized, the schematic diagram for the electrical system is seen to include original equipment components such as radio 25, relay 26 and harness 27, adapted for interconnection with the electronic converter apparatus 15 and replacement power antenna 16 of the invention. Replacement power antenna 16 comprises drive motor 85, associated rod contacts 86, 87 and replacement antenna relay 90 having coil 91, a pair of power contacts 92, 93 a pair of ground contacts 94, 95 and respective switching contacts 96, 97.

Replacement power antenna 16 is of the type commonly sold by automotive aftermarket suppliers. It is designed to be conventionally wired so that switching contract 96 is always powered and switching contact 97 is always grounded. Electricity is selectively supplied on a middle lead 89 which serves as a control lead. Electricity is supplied on middle 89 to make the antenna go up. When electricity is withdrawn the antenna goes down. As the electric current on middle lead 89 need only be great enough to power coil 90 of relay 91, the lead can be controlled by a small, low current switch.

As the electrical current pattern used by original equipment manufactures for their power antennas shown in FIG. 3 differs from that conventionally used with automotive aftermarket antennas, replacement antenna 16 can not be directly connected to the original system. The electronic converter apparatus of the present invention enables replacement antenna 16 to work despite the differences between the systems. Replacement antenna relay 90 is interconnected with the electronic converter apparatus 15 by means of interconnecting wire leads 24, which as noted in FIG. 4 are directly connected to wires 36, 38, 39 in cable 35, by means of the crimp-type wire connectors 40, 41, 41. As noted, the anode of diode 50 is connected to wire 36, the cathode of diode 51 is connected to wire 39, while the cathode of diode 50 and anode of diode 51 are connected in common to wire 38. Diodes 50, 51 and adjacent portions of wires 36, 38, 39 are encapsulated in plastic to form a rigid housing which provides physical protection and electrical insulation and which may conveniently be mounted adjacent replacement power antenna 16. Alternatively, diodes 50, 51 may be situated more closely adjacent replacement antenna relay 90, as the electrical interconnection would be the same. For this application, diodes 50, 51 may be any general purpose semiconductor diodes or other type rectifiers or switching devices, capable of handling moderate current levels at fairly low voltages.

In the circuitry described in FIG. 4, it will be seen that voltage is applied from power source 56 to original equipment relay terminal 72, as previously described, and thereby to wire 39 when block connectors 28, 32 are joined. Power so applied is routed via switching contact 96, power contact 93 and antenna rod contact 87 to drive motor 85. In the manner previously described, rod contact 87 will remain closed when the antenna rod is extended and will open when the rod is fully retracted. The ground side of motor 85 is established through the circuit of ground contact 94, switching contact 97, wire 36, diode 50 and wire 38 to output terminal 71 of original equipment relay 26.

When radio switch 55 is closed to energize original equipment relay 26, this will establish output terminal 71 in connection with power source 56 and output terminal 70 in connection with ground 57. Power applied to wire 38 will energize coil 91 in replacement antenna relay 90 to move switching contacts 96, 97 to their alternative positions. In this condition power will be supplied from wire 38, via diode 51, to wire 39. Switching contact 96 and power contact 92 to motor 85 are in electrical connection as the result of coil 90 being energized to actuate the motor in the opposite direction and extend the antenna rod. The ground circuit from motor 85 is established via rod contact 86, ground contact 95, switching contact 97 (coil 90 being engaged) and connecting wire 36 to output terminal 70. Motor rotation will continue until the antenna rod is fully extended and rod switch 86 is opened. Thus it will be apparent that diodes 50, 51 have established circuit paths for steering the electrical current between the original equipment relay 26 and replacement antenna relay 90 so that the proper mode of operation of the drive motor and antenna rod is obtained. Also, it will be clear that the interconnection between components is easily and readily performed, in a convenient, accessible location and that proper operating polarities are automatically established.

It will be understood by those skilled in the art using the converter apparatus feature of the present invention, the person installing a replacement antenna need not be concerned with whether the replacement antenna is being connected to an original equipment system such as that shown in FIG. 3 or a conventional replacement system. In a conventional replacement system wire 39 would always be supplied with power, wire 36 would always be grounded and line 38 would be powered when it is desired to make the antenna extend and unpowered when it is desired to make the antenna retract. If converter box 15 is connected in a manner similar to that shown in FIG. 4 to the wires of a conventional replacement system, the antenna will still work as intended as no electricity will pass through the diodes during operation of the antenna.

I claim:

1. Replacement antenna apparatus for a motor vehicle radio receiver system and the like, comprising an extendable antenna rod, motor means for moving said antenna rod between extended and retracted positions, contact means associated with said antenna rod for sensing the extended and retracted positions, an antenna relay having pairs of power contacts and pairs of ground contacts and an energizing coil for switching said contacts between first and second positions, a three wire cable interconnecting said antenna relay with a remote power source, first and second pairs of wires of said wire cable being alternately energizable, and first and second diodes connected between said first and second pairs of wires for directing current flow among the wires of said three wire cable.

2. The antenna apparatus set forth in claim 1 wherein said diodes are in electrical connection with the anode of one diode and the cathode of said second diode commonly connected.

3. The antenna apparatus set forth in claim 2 wherein said three wire cable and said diodes are combined as a separable unit interconnectable between said remote power source and said antenna relay.

4. The antenna apparatus set forth in claim 3 further including a block connector at one end of said three wire cable for push-in interconnection with the connector of an original equipment wiring harness for a power antenna.

5. The antenna apparatus set forth in claim 4 further including wire terminal connectors at the other end of said three wire cable for establishing electrical connection with said antenna relay of said replacement antenna.

6. The antenna apparatus set forth in claim 5 wherein said diodes are encapsulated in a block of plastic located between said block connector and said wire connectors.

7. An antenna system for motor vehicles and the like, comprising a power source, power switch means in a radio receiver, or the like, an original equipment relay having an energizing coil, a part of power contacts, a pair of ground contacts and three output terminals, different pairs of said output terminals being connected to said power source by said power and ground contacts of said original equipment relay when said coil is energized by said power switch means.

a pair of diodes connected between said three output terminals in a serial connection with the anode of one diode and the cathode of the other diode in common electrical connection with one said terminal, and a replacement power antenna energizable from said power source, comprising an extendable antenna rod, motor means for moving said antenna rod, and a replacement antenna relay for electrically interconnecting said motor means for extending and retracting movement, said replacement relay having three terminal leads, and means electrically interconnecting said replacement relay terminal leads with said original equipment relay terminals for supplying electrical power there between.

8. The antenna systems set forth in claim 7 wherein said original equipment relay is permanently housed in said motor vehicle and the like and further including a three wire harness having an accessible block connector at one end, connected to said original equipment relay output terminals, said pair of diodes being housed in a replacement wire cable connectable to said replacement antenna apparatus.

9. The antenna system set forth in claim 8 wherein said replacement wire cable includes a block connector at one end mateable with said original equipment harness block connector for readily interconnecting said replacement antenna apparatus.

10. The antenna system set forth in claim 9 wherein said replacement antenna apparatus further comprises a pair of contacts alternately switchable at either end of travel of said antenna rod for stopping said motor and for redirecting power flow thereto, said replacement antenna relay having pairs of power contacts and ground contacts engageable by respective movable contacts for directing power to said motor means.

11. The antenna system set forth in claim 10 wherein said replacement wire cable is interconnected with said replacement antenna apparatus by a plurality of wire connectors.

12. The antenna system set forth in claim 11 wherein said diodes are encapsulated in a plastic block in said replacement wire cable and extended wire leads interconnect said wire terminals, said block connector and said pair of diodes to facilitate electrical interconnection in said antenna system.

* * * * *